US006414565B1

(12) United States Patent
Tanaka et al.

(10) Patent No.: US 6,414,565 B1
(45) Date of Patent: Jul. 2, 2002

(54) VARIABLE ATTENUATOR AND MOBILE COMMUNICATION APPARATUS

(75) Inventors: Koji Tanaka, Shiga-ken; Toshifumi Oida, Omihachiman; Norio Nakajima, Takatsuki, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/376,777

(22) Filed: Aug. 17, 1999

(30) Foreign Application Priority Data

Oct. 20, 1998 (JP) ..... 10-298897

(51) Int. Cl.[7] ..... H01P 1/22
(52) U.S. Cl. ..... 333/81 A; 333/116; 333/81 R
(58) Field of Search ..... 333/81 A, 81 R, 333/116

(56) References Cited

U.S. PATENT DOCUMENTS 5,233,317 A * 8/1993 Snodgrass et al. ..... 333/81 A
5,477,200 A * 12/1995 Ono ..... 333/81 R
5,841,328 A * 11/1998 Hayashi ..... 333/116

* cited by examiner

*Primary Examiner*—Robert Pascal
*Assistant Examiner*—Stephen E. Jones
(74) *Attorney, Agent, or Firm*—Ostrolenk, Faber, Gerb & Soffen, LLP

(57) ABSTRACT

A variable attenuator is provided with a comb line formed of first and second lines electromagnetically coupled at a coupling degree of M, and diodes connected to the first and second lines constituting the comb line. One end of the first line is grounded through a capacitor and also connected to an input terminal through a capacitor. A diode is connected between the ground and the other end of the first line such that its anode is connected to the other end of the first line. The node connecting the other end of the first line and the anode of the diode is connected to a control terminal through a resistor. One end of the second line is grounded through a capacitor and also connected to an output terminal through a capacitor. Another diode is connected between the ground and the other end of the second line such that its anode is connected to the other end of the second line. The node connecting the other end of the second line and the anode of the diode is connected to a control terminal through a resistor.

29 Claims, 5 Drawing Sheets

VARIABLE ATTENUATOR AND MOBILE COMMUNICATION APPARATUS

BACKGROUND OF THE INVENTION

1. Field of the Invention

The present invention relates to variable attenuators and mobile communication apparatuses.

2. Description of the Related Art

In general, a mobile communication apparatus such as a portable telephone is provided with a variable attenuating unit in which a plurality of attenuators having different attenuations are switched into use in 1order to variably attenuate a high-frequency signal.

FIG. 8 shows a conventional variable attenuating unit used in the microwave band. A variable attenuating unit 70 includes an input terminal 71, an output terminal 72, field-effect transistors (hereinafter called FETs) 731 to 733 and 741 to 743 for permitting connection and disconnection from the input to output, and T-shaped resistor attenuators 751 to 753 having attenuations of A dB, B dB, and C dB, respectively. The drain electrodes D of the input-side FETs 731 to 733, are connected to the input terminal 71 through a capacitor C71, and the drain electrodes D of the output-side FETs 741 to 743, are connected to the output terminal 72 through a capacitor C72. The sources S of the FETs 731 to 733 are connected to ends of resistors R71 to R73 of the T-shaped resistor attenuators 751 to 753 through capacitors C73 to C75, respectively, and the sources S of the FETs 741 to 743 are connected to ends of resistors R74 to R76 of the T-shaped resistor attenuators 751 to 753 through capacitors C76 to C78, respectively. The other ends of the resistors R71 to R73 are connected to the other ends of the resistors R74 to R76, respectively, in the T-shaped resistor attenuators, and the connection points are grounded through resistors R77 to R79. The gate electrodes G of the FETs 731 to 733 and 741 to 743 are grounded through capacitors C79 to C84, respectively, and connected to control terminals Vc71 to Vc76 through high-frequency blocking inductors L71 to L76, respectively.

A negative voltage about equal to the pinch-off voltage of an FET to be controlled (e.g., ØV) is selectively applied to the control terminals Vc71 to Vc76. When 0 V is applied to the control terminals Vc71 and Vc74 of FETs 731 and 741, which are included in a first path, the channel resistances between the drains and sources of the FETs 731 and 741 become sufficiently lower than the characteristic impedance of the T-shaped resistor attenuator 751. When negative voltages about equal to the pinch-off voltages of the FETs 732, 742, 733, and 743 (which are included in second and third paths, respectively) are applied to the control terminals Vc72, Vc75, Vc73, and Vc76, the channel resistances between the drains and sources of the FETs 732, 742, 733, and 743 become extremely high because the depletion layers extend in the channels. As a result, a microwave input into the input terminal 71 passes through only the first path, including the T-shaped resistor attenuator 751. The second and third paths, including the T-shaped resistor attenuators 752 and 753, respectively, are in cut-off states. Therefore, attenuation between the input terminal 71 and the output terminal 72 is A dB.

To switch the attenuation between the input terminal 71 and the output terminal 72 to B dB, 0 V is applied to the control terminals Vc72 and Vc75 of FETs 732, 742 of the second path, and negative voltages about equal to the pinch-off voltages of the FETs 731, 741, 733, and 743 are applied to the control terminals Vc71, Vc74, Vc73, and Vc76 such that only the second path, including the T-shaped resistor attenuator 752, is in a pass condition. The attenuation can be switched to C dB by a similar operation. With these operations, a plurality of attenuations can be variably controlled in a discontinuous manner.

In the above conventional variable attenuating unit, however, since a plurality of attenuators having different attenuations are switched using switches, the attenuation cannot be variably controlled in a continuous manner.

In addition, since the number of FETs required for the switches is double that of the attenuations to be variably controlled, the total number of components becomes large, and the structures of the switches become complicated. Thus, the structure of the variable attenuating unit itself becomes complicated and large, and its manufacturing cost increases.

SUMMARY OF THE INVENTION

To overcome the above described problems, preferred embodiments of the present invention provide a compact variable attenuator and a compact mobile communication apparatus which allow attenuation to be variably controlled in a continuous manner.

One preferred embodiment of the present invention provides a variable attenuator comprising: a comb line comprising a first line and a second line electromagnetically coupled to each other; and a plurality of diodes connected to the first and second lines constituting the comb line; one end of each of the first and second lines being grounded; and the diodes being connected between the ground and the other ends of the first and second lines such that the anodes of the diodes are connected to the other ends of the first and second lines.

According to the above described variable attenuator, since the diodes are connected between the ground and the other ends of the first and second lines constituting the comb line, when a voltage applied to the diodes is variably controlled, the resistances of the diodes are variably controlled. As a result, the coupling degree of the first and second lines constituting the comb line is variably controlled. Therefore, the level of a high-frequency signal sent from the input port of the comb line to the output port is variably controlled. This means that the attenuation of the variable attenuator is variably controlled. In addition, the reflection loss is made to −13 dB or less when the voltage standing-wave ratio (VSWR) is 1.5 or less.

Since the diodes are connected between the ground and the other ends of the first and second lines constituting the comb line, the input terminal, the output terminal, and the diodes are connected to different ends of the first and second lines. Therefore, while the diodes are on or off, the impedance of the first line viewed from the input terminal and the impedance of the second line viewed from the output terminal can be made identical to the characteristic impedance of the high-frequency circuit section of a mobile communication apparatus on which the variable attenuator is mounted.

In addition, since the variable attenuator comprises the comb line and the diodes, its structure is simple. As a result, the variable attenuator can be made compact and its manufacturing cost can be reduced.

The above described variable attenuator may comprise a plurality of the comb lines. The plurality of the comb lines are connected to each other in cascade such that one end of a first line of the comb line is connected to one end of a second line of the adjacent comb line among the plurality of the comb lines.

According to the variable attenuator, since a plurality of comb lines are connected in cascade, the attenuation can be variably controlled in an extended range. Therefore, the number of components used in a mobile communication apparatus on which such a variable attenuator is mounted can be reduced. As a result, the mobile communication apparatus can be made compact.

The above described variable attenuator may further comprise a ceramic substrate formed by laminating a plurality of sheet layers made of ceramic, strip electrodes constituting the comb line being built in said ceramic substrate, and the diodes being mounted on said ceramic substrate.

According to the above described variable attenuator, since the ceramic substrate formed by laminating a plurality of sheet layers made of ceramic is provided and the ceramic substrate includes the strip electrodes constituting the comb line, a high-frequency band of 1 GHz or more can be handled due to a wavelength reduction effect of the ceramic substrate.

The foregoing object is achieved in another aspect of the present invention through the provision of a mobile communication apparatus including the above variable attenuator. According to the mobile communication apparatus, since a compact variable attenuator is used, a compact mobile communication apparatus can be implemented while a constant receiving balance of receiving sections are maintained.

Other features and advantages of the present invention will become apparent from the following description of the invention which refers to the accompanying drawings.

DESCRIPTION OF THE PREFERRED EMBODIMENTS

Figure 1:
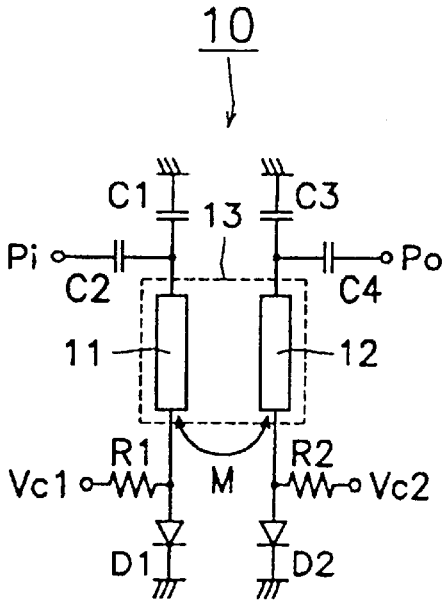
FIG. 1 is a circuit diagram of a variable attenuator according to a first embodiment of the present invention.

FIG. 1 is a view showing a structure of a variable attenuator according to a first embodiment of the present invention. A variable attenuator 10 is provided with a comb line 13 comprising first and second lines 11 and 12 electromagnetically coupled to each other at a coupling degree of M, and diodes D1 and D2 connected to the first and second lines 11 and 12 constituting the comb line 13.

One end of the first line 11, which is a part of the comb line 13, is grounded through a capacitor C1 and also connected to an input terminal Pi through a capacitor C2. One end of the second line 12, which is a part of the comb line 13, is grounded through a capacitor C3 and also connected to an output terminal Po through a capacitor C4.

Diode D1 is connected between ground and the other end of the first line 11 such that its anode is connected to the first line 11. The node connecting first line 11 and the anode of the diode D1 is connected to a control terminal Vc1 through a resistor R1.

Diode D2 is connected between the ground and the other end of the second line 12 such that its anode is connected to the second line 12. The node connecting second line 12 and the anode of the diode D2 is connected to a control terminal Vc2 through a resistor R2.

The input terminal Pi and the output terminal Po of the comb line 13 are symmetrical against the first and second lines 11 and 12.

The operation of. the variable attenuator 10, having the above circuit structure, will be described below. When a positive voltage is applied to the diodes D1 and D2 through the control terminals Vc1 and Vc2, the resistances of the diodes D1 and D2 reduces, and the degree of coupling between the first and second lines 11 and 12 constituting the comb line 13 reduces. As a result, the level of a high-frequency signal sent from the input terminal Pi to the output terminal Po through the first and second lines 11 and 12 reduces. Thus, the attenuation of the variable attenuator 10 increases. More particularly, as a voltage applied to the diodes D1 and D2 through the control terminals Vc1 and Vc2 increases from 0 V, the resistances of the diodes D1 and D2 gradually decrease. As a result, a magnitude of a high-frequency signal sent from the input terminal Pi to the output terminal Po through the first and second lines 11 and 12 is gradually reduced. Thus, the attenuation of the variable attenuator 10 gradually increases.

Therefore, when a voltage applied through the control terminals Vc1 and Vc2 is variably controlled, the resistances of the diodes D1 and D2 are variably controlled and the coupling degree of the first and second lines 11 and 12 is also variably controlled. As a result, a high-frequency signal sent from the input terminal Pi to the output terminal Po through the first and second lines 11 and 12 is variably controlled. Thus, the attenuation of the variable attenuator 10 is variably controlled.

Figure 2:
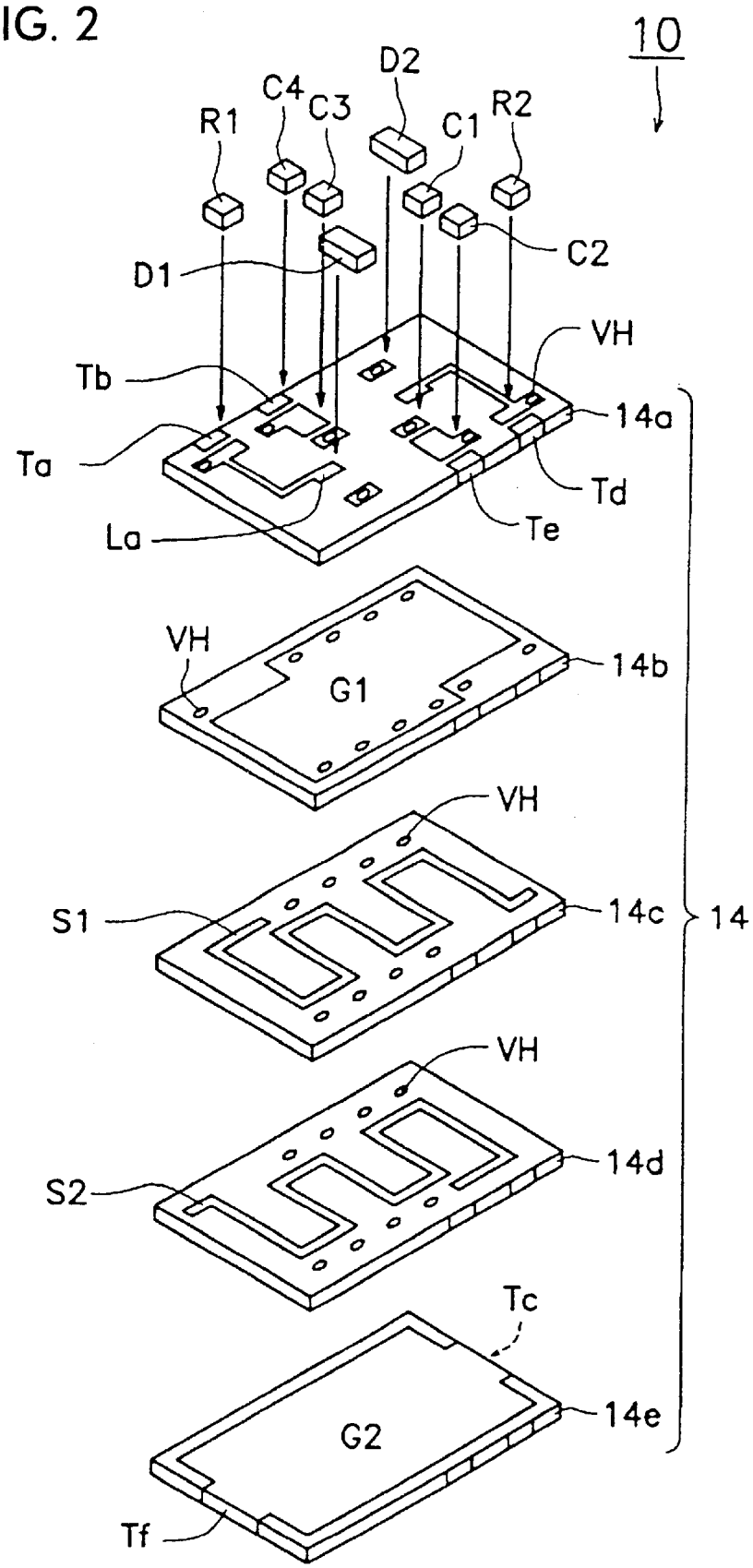
FIG. 2 is an exploded perspective view of the variable attenuator shown in FIG. 1.

FIG. 2 is an exploded perspective view of a variable attenuator corresponding to the circuit shown in FIG. 1. The variable attenuator 10 is provided with a ceramic substrate 14 formed by laminating sheet layers 14*a* to 14*e*, which we made from ceramics mainly including barium oxide, aluminum oxide, and silica. The layers are burned at a burning temperature of 1000 degrees centigrade or less.

The diodes D1 and D2, the capacitors C1 to C4, and the resistors R1 and R2 are mounted on the ceramic substrate 14. At side faces of the ceramic substrate 14, the input terminal Pi, the output terminal Po, the control terminals Vc1 and Vc2, and external terminals Ta to Tf, serving as ground terminals, are formed by screen printing.

Among the sheet layers 14*a* to 14*e* constituting the ceramic substrate 14, strip electrodes S1 and S2, made from copper, are formed on the sheet layers 14*c* and 14*d*. These strip electrodes form the first and second lines 11 and 12 of the comb line 13. Ground electrodes G1 and G2, made from copper, are formed on the sheet layers 14*b* and 14*e*, and lands La, also made from copper, facilitate mounting the diodes D1 and D2, the capacitors C1 and C4. The resistors R1 and R2 are formed on the sheet layer 14*a* by screen printing or other known methods.

Among the sheet layers 14*a* to 14*e* constituting the ceramic substrate 14, via-hole electrodes VH are formed in the sheet layers 14*a* to 14*d* to connect the strip electrodes S1 and S2, the ground electrodes G1 and G2, and the lands La.

Figure 3:
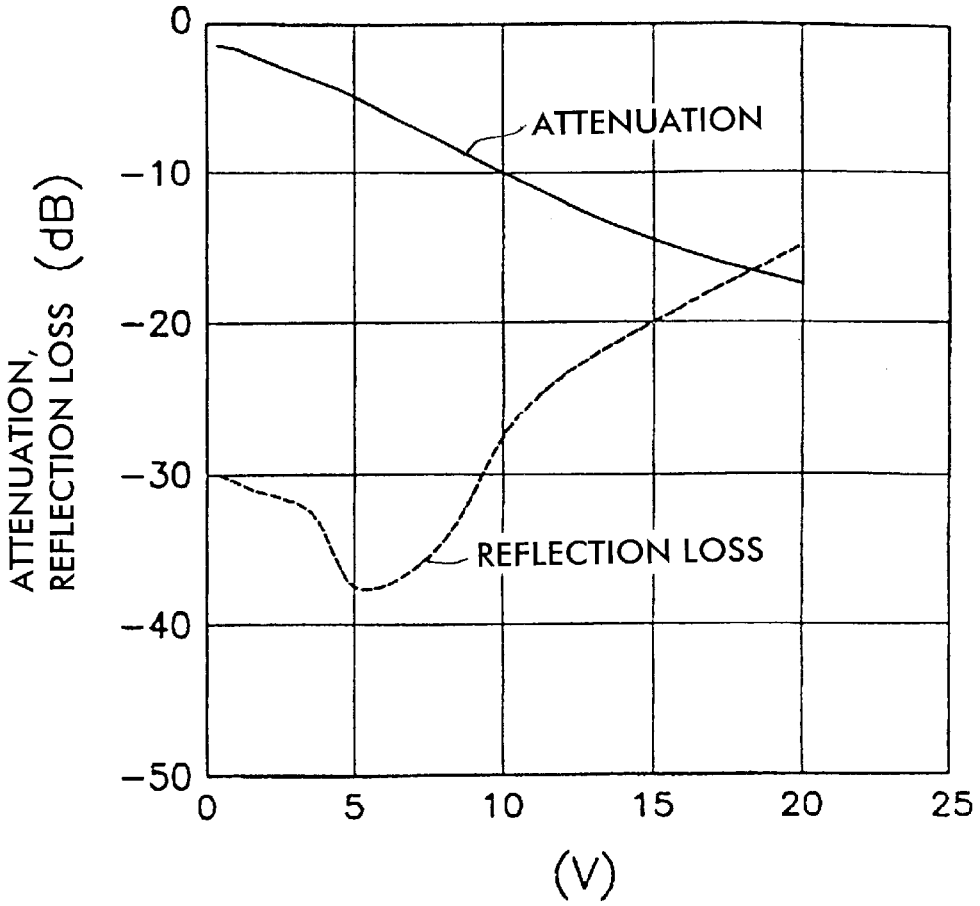
FIG. 3 is a graph showing. the attenuation and the reflection loss versus voltage of the variable attenuator shown in FIG. 1.

FIG. 3 is a graph showing changes of the attenuation and the reflection loss versus voltage of the variable attenuator shown in FIG. 1. In this case, a voltage applied to the diodes D1 and D2 through the control terminals Vc1 and Vc2 is changed in a range of 0.4 V to 20 V to change the resistances of the diodes D1 and D2.

The horizontal axis in FIG. 3 indicates the voltage applied to the diodes D1 and D2. The reflection loss is shown when the voltage standing-wave ratio (VSWR) is 1.5 or less.

It is clearly understood from FIG. 3 that, when a voltage applied to the diodes D1 and D2 through the control terminals Vc1 and Vc2 is controlled in a range of 0.4 V to 20 V to control the resistances of the diodes D1 and D2, the attenuation of the variable attenuator 10 is controlled in a range of −0.6 dB to −17.5 dB and the reflection loss is −15 dB or less when the VSWR is 1.5 or less.

Figure 4:
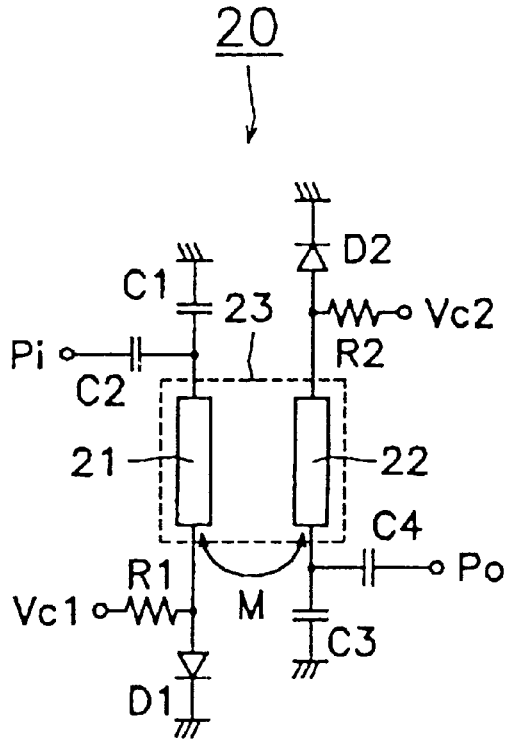
FIG. 4 is a circuit diagram of a variable attenuator according to a second embodiment of the present invention.

FIG. 4 is a view showing a variable attenuator according to a second embodiment of the present invention. A variable attenuator 20 is provided with a comb line 23 formed of first and second lines 21 and 22 electromagnetically coupled at a coupling degree of M, and diodes D1 and D2 connected to the first and second lines 21 and 22.

One end of the first line 21 is grounded through a capacitor C1 and also connected to an input terminal Pi through a capacitor C2. One end of the second line 22 is grounded through a capacitor C3 and also connected to an output terminal Po through a capacitor C4.

Diode D1 is connected between the ground and the other end of the first line 21 such that its anode is connected to the first line 21. The node connecting the other end of the first line 21 and the anode of the diode D1 is connected to a control terminal Vc1 through a resistor R1.

Diode D2 is connected between the ground and the other end of the second line 22 such that its anode is connected to the second line 22. The node connecting the other end of the second line 22 and the anode of the diode D2 is connected to a control terminal Vc2 through a resistor R2.

The input terminal Pi and the output terminal Po of the comb line 23 are symmetrical against the first and second lines 21 and 22.

The operation of the variable attenuator 20 having the above circuit structure is the same as that of the variable attenuator 10 described in the first embodiment. When a voltage applied through the control terminals Vc1 and Vc2 is variably controlled, the resistances of the diodes D1 and D2 are variably controlled and the coupling degree of the first and second lines 21 and 22 is also variably controlled. As a result, a high-frequency signal sent from the input terminal Pi to the output terminal Po through the first and second lines 21 and 22 is variably controlled. Thus, the attenuation of the variable attenuator 20 is variably controlled.

According to each of the variable attenuators described in the first and second embodiments, since the diodes are connected between the ground and the other ends of the first and second lines constituting the comb line, when a voltage applied to the diodes is variably controlled, the resistances of the diodes are variably controlled. As a result, the coupling degree of the first and second lines constituting the comb line is variably controlled. Therefore, the level of a high-frequency signal sent from the input port of the comb line to the output port is variably controlled. Thus, the attenuation of the variable attenuator is variably controlled. In addition, the reflection loss is −13 dB or less when the VSWR is 1.5 or less.

Since the diodes are connected between the ground and the other ends of the first and second lines constituting the comb line, the input terminal, the output terminal, and the diodes are connected to different ends of the first and second lines. Therefore, while the diodes are on or off, the impedance of the first line viewed from the input terminal and the impedance of the second line viewed from the output terminal can be made identical to the characteristic impedance of the high-frequency circuit section of a mobile communication apparatus on which the variable attenuator is mounted.

In addition, since the variable attenuator is formed of the comb line and the diodes, its structure is simple. As a result, the variable attenuator is compact and its manufacturing cost is reduced.

Furthermore, the ceramic substrate formed by laminating a plurality of sheet layers made from ceramics is provided and the ceramic substrate includes the strip electrodes made from copper, which serve as the comb line. Advantageously, a high-frequency band of 1 GHz or more can be handled due to a wavelength reduction effect of the ceramic substrate and reduction in loss caused by the use of copper.

Figure 5:
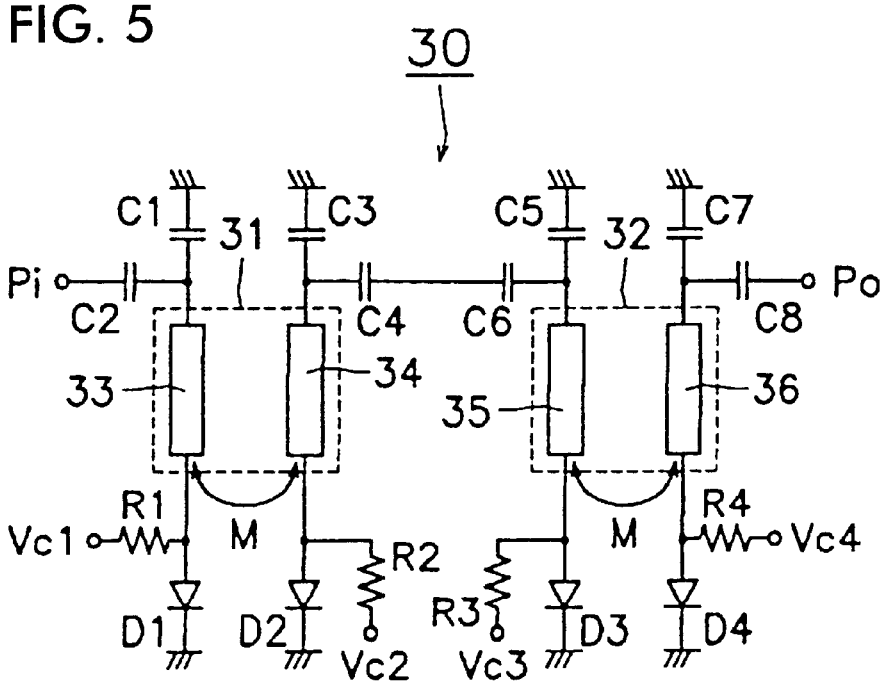
FIG. 5 is a circuit diagram of a variable attenuator according to a third embodiment of the present invention.

FIG. 5 is a circuit diagram of a variable attenuator according to a third embodiment of the present invention. A variable attenuator 30 differs from the variable attenuator 10 (shown in FIG. 1) described in the first embodiment in that two comb lines 31 and 32 are connected in series.

Since one end of a second line 34 constituting a comb line 31, which is adjacent to a comb line 32, is connected to one end of a first line 35 constituting the comb line 32 through capacitors C4 and C6, the comb lines 31 and 32 are connected in a cascade arrangement.

One end of a first line 33 (which is part of the comb line 31) is grounded through a capacitor C1 and also connected to an input terminal Pi through a capacitor C2. Diodes D1 and D2 are connected between the ground and the respective other ends of the first and second lines 33 and 34 of the comb line 31, such that their anodes are connected to the first and second lines 33 and 34, respectively. The nodes connecting the other ends of the first and second lines 33 and 34 and the anodes of the diodes D1 and D2 are connected to control terminals Vc1 and Vc2 through resistors R1 and R2, respectively.

One end of a second line 36 constituting the comb line 32 is grounded through a capacitor C7 and also connected to an output terminal Po through a capacitor C8. Diodes D3 and D4 are connected between the ground and the other ends of the first and second lines 35 and 36 of the comb line 32 such that their anodes are connected to the first and second lines 35 and 36, respectively. The nodes connecting the other ends of the first and second lines 35 and 36 and the anodes of the diodes D3 and D4 are connected to control terminals Vc3 and Vc4 through resistors R3 and R4, respectively.

Figure 6:
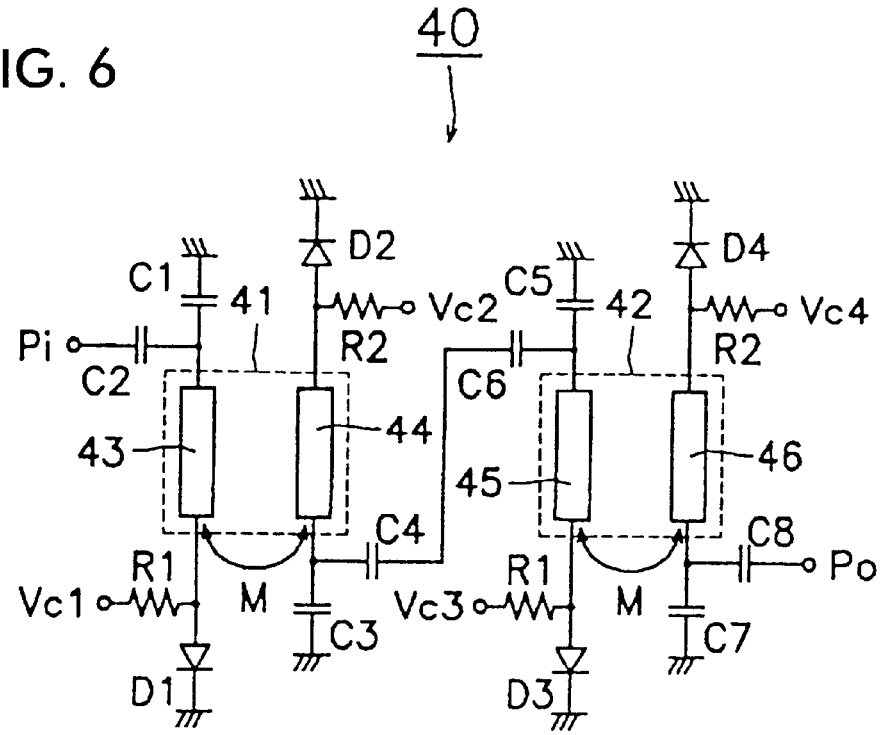
FIG. 6 is a circuit diagram of a variable attenuator according to a fourth embodiment of the present invention.

FIG. 6 is a circuit diagram of a variable attenuator according to a fourth embodiment of the present invention. A variable attenuator 40 differs from the variable attenuator 20 (shown in FIG. 4) described in the second embodiment in that two comb lines 41 and 42 are connected in series.

Since one end of a second line 44 constituting a comb line 41, which is adjacent to a comb line 42, is connected to one end of a first line 45 constituting the comb line 42 through capacitors C4 and C6, the comb lines 41 and 42 are connected in a cascade arrangement.

One end of a first line 43 constituting the comb line 41 is grounded through a capacitor C1 and also connected to an input terminal Pi through a capacitor C2. Diodes D1 and D2 are connected between the ground and the other ends of the first and second lines 43 and 44 of the comb line 41 such that their anodes are connected to the other ends of the first and second lines 43 and 44, respectively. The nodes connecting the other ends of the first and second lines 43 and 44 and the anodes of the diodes D1 and D2 are connected to control terminals Vc1 and Vc2 through resistors R1 and R2, respectively.

One end of a second line 46 constituting the comb line 42 is grounded through a capacitor C7 and also connected to an output terminal Po through a capacitor C8. Diodes D3 and D4 are connected between the ground and the other ends of the. first and second lines 45 and 46 of the comb line 42 such that their anodes are connected to the other ends of the first and second lines 45 and 46, respectively. The nodes connecting the other ends of the first and second lines 45 and 46 and the anodes of the diodes D3 and D4 are connected to control terminals Vc3 and Vc4 through resistors R3 and R4, respectively.

According to the variable attenuators of the third and fourth embodiments, since a plurality of comb lines are connected in a cascade arrangement, the attenuation can be variably controlled in an extended range. Therefore, the number of components used in a mobile communication apparatus on which such a variable attenuator is mounted can be reduced. As a result, the mobile communication apparatus can be more compact.

Figure 7:
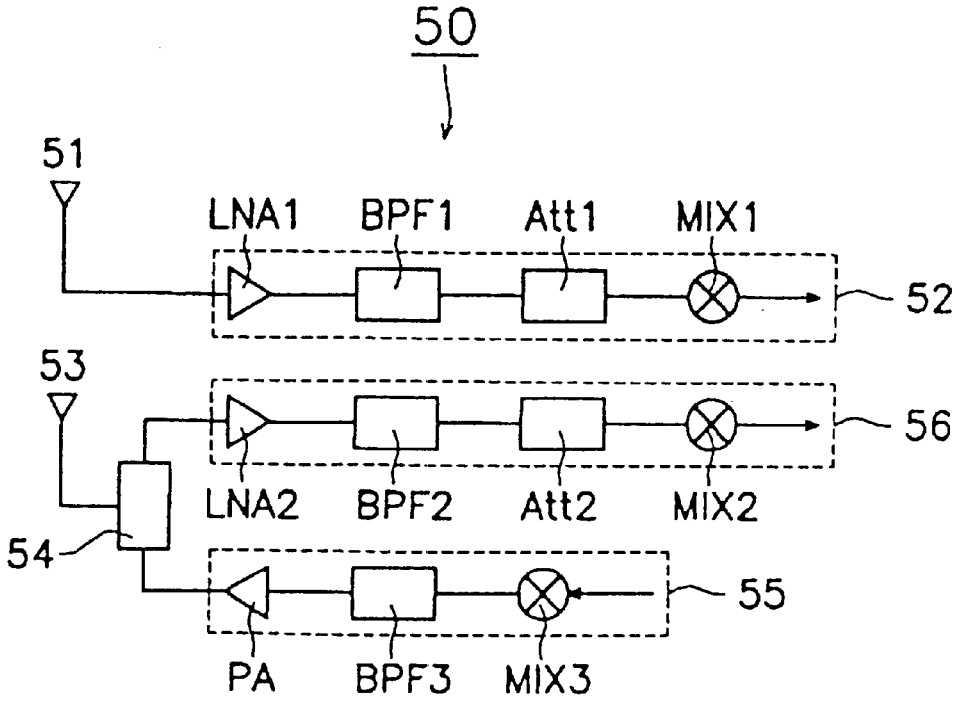
FIG. 7 is a block diagram of a portable telephone, which is a mobile communication apparatus.
Figure 8:
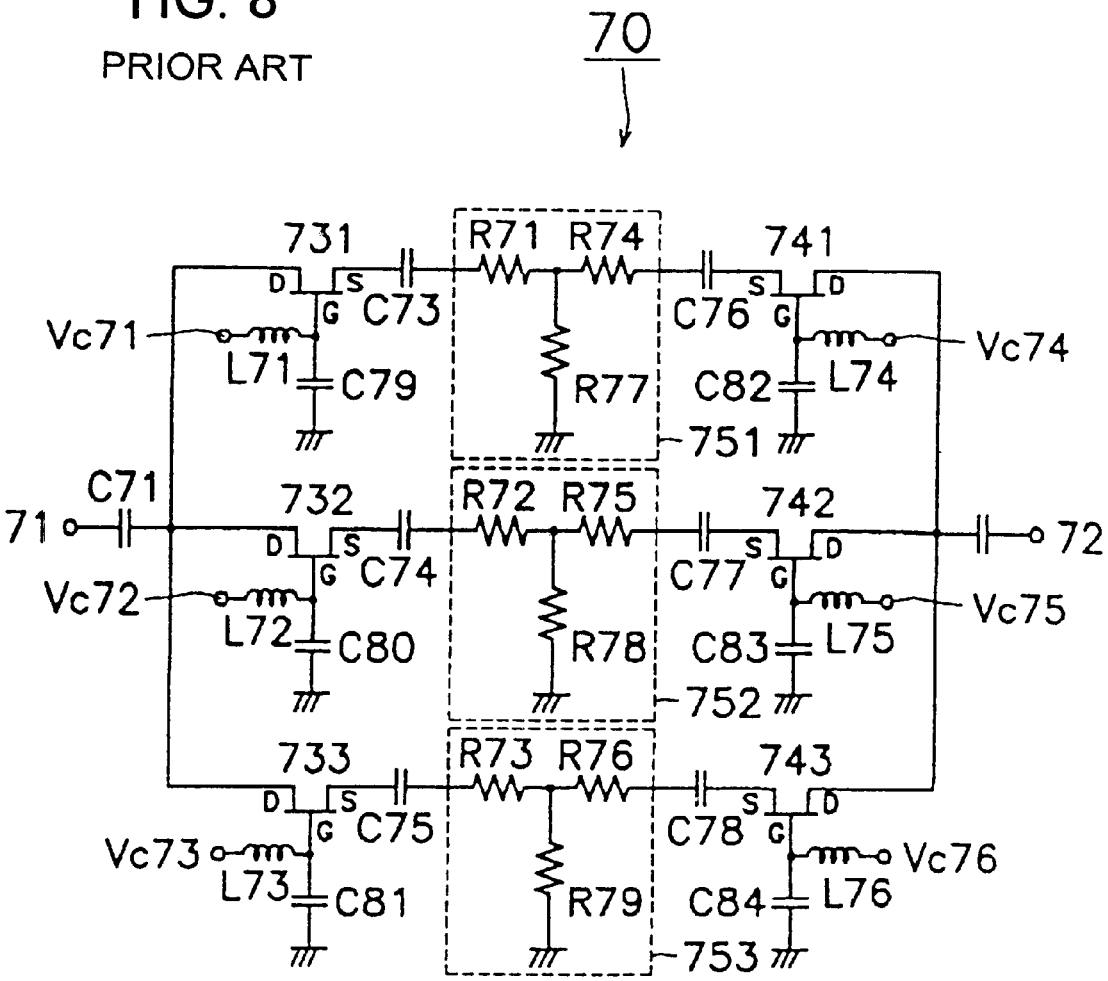
FIG. 8 PRIOR ART
FIG. 8 is a circuit diagram of a prior art variable attenuating unit.

FIG. 7 is a block diagram of a portable telephone used in a personal cellular system (PCS), which is a mobile communication apparatus. A portable telephone 50 includes a receiving-only antenna 51, a first receiving section 52 corresponding to the antenna 51, a receiving and transmitting antenna 53, a duplexer 54 connected to the antenna 53, a transmission section 55 corresponding to the antenna 53, and a second receiving section 56 corresponding to the antenna 53.

The first and second receiving sections 52 and 56 include low-noise amplifiers LNA1 and LNA2, bandpass filters BPF1 and BPF2, attenuating units Att1 and Att2, and mixers MIX1 and MIX2, respectively. The transmission section 55 includes a high-output amplifier Pa, a bandpass filter BPF3, and a mixer MIX3. The attenuating units Att1 and Att2 are used for making the receiving balance constant.

When the compact attenuators 10, 20, 30, and 40 shown in FIG. 1 and FIG. 4 to FIG. 6 are used for the attenuating units Att1 and Att2 included in the first and second receiving sections 52 and 56 in this structure, a compact mobile telephone is achieved while a constant receiving balance of the receiving sections is maintained.

In the above first to fourth embodiments, one end of each of the first and second lines constituting a comb line is grounded through a capacitor. It may alternatively be directly grounded without a capacitor.

A control terminal through which a voltage is applied to a diode is provided at one end of each of the first and second lines constituting a comb line. A control terminal may alternatively be provided at any part of each of the first and second lines.

In the above third and fourth embodiments, two comb lines are connected in a cascade arrangement. Three or more comb lines may be connected in a cascade arrangement in accordance with the invention. In this case, as the number of comb lines increases, the attenuation is variably controlled in a more extended range. While the invention has been particularly shown and described with reference to preferred embodiments thereof, it will be understood by those skilled in the art that the forgoing and other changes in form and details may be made therein without departing from the spirit of the invention. Accordingly, the invention should not be limited by the particular embodiments disclosed herein, but rather by the claims attached hereto.

What is claimed is:

1. A variable attenuator, comprising:

a comb line including first and second lines electromagnetically coupled to each other, each line having respective ends;

a first diode having an anode and a cathode, the anode of the first diode being coupled to one end of the first line and the cathode being coupled to ground;

a second diode having an anode and a cathode, the anode of the second diode being coupled to one end of the second line and the cathode being coupled to ground;

a first control terminal coupled to the anode of the first diode and the corresponding end of the first line; and a second control terminal coupled to the anode of the second diode and the corresponding end of the second line, wherein an amount of coupling from the first line to the second line is variable as a continuous function of control voltages applied to the first and second control terminals.

2. The variable attenuator of claim 1, further comprising:

an input terminal coupled to an opposite end of the first line from the anode of the first diode;

an output terminal coupled to an opposite end of the second line from the anode of the second diode;

wherein an amount of attenuation from the input terminal to the output terminal is variable as a continuous function of the control voltages applied to the first and second control terminals.

3. The variable attenuator of claim 2, wherein the coupling from the first line to the second line reduces as the control voltages increase with respect to ground.

4. The variable attenuator of claim 2, wherein the attenuation from the input terminal to the output terminal increases as the control voltages increase with respect to ground.

5. The variable attenuator of claim 2, wherein the first and second control terminals are resistively coupled to the respective anodes of the first and second diodes and the respective corresponding ends of the first and second lines.

6. The variable attenuator of claim 2, wherein the input and output terminals are capacitively coupled to the respective opposite ends of the first and second lines.

7. The variable attenuator of claim 6, wherein the respective opposite ends of the first and second lines are coupled to ground.

8. The variable attenuator of claim 6, wherein the respective opposite ends of the first and second lines are capacitively coupled to ground.

9. A variable attenuator, comprising:

a plurality of stacked ceramic layers, each layer including opposing main surfaces and side surfaces;

a comb line formed from first and second strip lines each having respective ends, the first strip line being disposed on a main surface of one ceramic layer and the second strip line being disposed on a main surface of an adjacent ceramic layer such that they are electromagnetically coupled to each other;

a first diode having an anode and a cathode, the anode of the first diode being coupled to one end of the first strip line and the cathode being coupled to ground;

a second diode having an anode and a cathode, the anode of the second diode being coupled to one end of the second strip line and the cathode being coupled to ground;

a first control terminal coupled to the anode of the first diode and the corresponding end of the first strip line; and a second control terminal coupled to the anode of the second diode and the corresponding end of the second strip line, wherein an amount of coupling from the first strip line to the second strip line is variable as a continuous function of control voltages applied to the first and second control terminals.

10. The variable attenuator of claim 9, further comprising:

an input terminal coupled to an opposite end of the first strip line from the anode of the first diode;

an output terminal coupled to an opposite end of the second strip line from the anode of the second diode;

wherein an amount of attenuation from the input terminal to the output terminal is variable as a continuous function of the control voltages applied to the first and second control terminals.

11. The variable attenuator of claim 10, wherein the coupling from the first strip line to the second strip line reduces as the control voltages increase with respect to ground.

12. The variable attenuator of claim 10, wherein the attenuation from the input terminal to the output terminal increases as the control voltages increase with respect to ground.

13. The variable attenuator of claim 10, wherein the first and second control terminals are resistively coupled to the respective anodes of the first and second diodes and the respective corresponding ends of the first and second strip lines.

14. The variable attenuator of claim 10, wherein the input and output terminals are capacitively coupled to the respective opposite ends of the first and second strip lines.

15. The variable attenuator of claim 10, wherein the respective opposite ends of the first and second strip lines are coupled to ground.

16. The variable attenuator of claim 15, wherein the respective opposite ends of the first and second strip lines are capacitively coupled to ground.

17. The variable attenuator of claim 16, wherein a first one and a second one of the ceramic layers each includes a ground plane disposed on a main surface thereof, the first ceramic layer disposed over the first strip line such that the ground plane capacitively couples thereto, and the second ceramic layer disposed over the second strip line such that the ground plane capacitively couples thereto.

18. A variable attenuator, comprising:

a first comb line including first and second lines electromagnetically coupled to each other, each line having respective ends;

a first diode having an anode and a cathode, the anode of the first diode being coupled to one end of the first line and the cathode being coupled to ground;

a second diode having an anode and a cathode, the anode of the second diode being coupled to one end of the second line and the cathode being coupled to ground;

a second comb line including third and fourth lines electromagnetically coupled to each other, each line having respective ends;

a third diode having an anode and a cathode, the anode of the third diode being coupled to one end of the third line and the cathode being coupled to ground;

a fourth diode having an anode and a cathode, the anode of the fourth diode being coupled to one end of the fourth line and the cathode being coupled to ground, the opposite ends of the second and third lines from the respective anodes of the second and third diodes, respectively, being coupled to each other such that the first and second comb lines are cascaded;

a first control terminal coupled to the anode of the first diode and the corresponding end of the first line;

a second control terminal coupled to the anode of the second diode and the corresponding end of the second line;

a third control terminal coupled to the anode of the third diode and the corresponding end of the third line; and a fourth control terminal coupled to the anode of the fourth diode and the corresponding end of the fourth line, wherein amounts of coupling from the first line to the second line and from the third line to the fourth line are variable as continuous functions of control voltages applied to the first and second and the third and fourth control terminals, respectively.

19. The variable attenuator of claim 18, further comprising:

an input terminal coupled to an opposite end of the first line from the anode of the first diode;

an output terminal coupled to an opposite end of the fourth line from the anode of the fourth diode;

wherein an amount of attenuation from the input terminal to the output terminal is variable as a continuous function of the control voltages applied to the first and second and the third and fourth control terminals, respectively.

20. The variable attenuator of claim 19, wherein the coupling from the first line to the second line and the coupling from the third line to the fourth line reduce as the respective control voltages increase with respect to ground.

21. The variable attenuator of claim 19, wherein the attenuation from the input terminal to the output terminal increases as the respective control voltages increase with respect to ground.

22. The variable attenuator of claim 19, wherein the first, second, third, and fourth control terminals are resistively coupled to the respective anodes of the first, second, third, and fourth diodes and the respective corresponding ends of the first, second, third, and fourth lines.

23. The variable attenuator of claim 19, wherein the input and output terminals are capacitively coupled to the respective opposite ends of the first and fourth lines.

24. The variable attenuator of claim 23, wherein the respective opposite ends of the first, second, third, and fourth lines are coupled to ground.

25. The variable attenuator of claim 23, wherein the respective opposite ends of the first, second, third, and fourth lines are capacitively copled to ground.

26. The variable attenuator of claim 18, wherein the opposite ends of the second and third lines from the respective anodes of the second and third diodes, respectively, are capacitively coupled to each other such that the first and second comb lines are cascaded.

27. A communications apparatus, comprising:

a receiver;

a transmitter; and a variable attenuator disposed within at least one of the receiver and the transmitter, the variable attenuator comprising:

a comb line including first and second lines electromagnetically coupled to each other, each line having respective ends;

a first diode having an anode and a cathode, the anode of the first diode being coupled to one end of the first line and the cathode being coupled to ground;

a second diode having an anode and a cathode, the anode of the second diode being coupled to one end of the second line and the cathode being coupled to ground;

an input terminal coupled to an opposite end of the first line from the anode of the first diode;

an output terminal coupled to an opposite end of the second line from the anode of the second diode;

a first control terminal coupled to the anode of the first diode and the corresponding end of the first line; and a second control terminal coupled to the anode of the second diode and the corresponding end of the second line, wherein:

an amount of attenuation from the input terminal to the output terminal is variable as a continuous function of control voltages applied to the first and second control terminals, and an amount of coupling from the first line to the second line is variable as a continuous function of the control voltages applied to the first and second control terminals.

28. The communications apparatus of claim 27, wherein (i) the coupling from the first line to the second line reduces, and (ii) the attenuation from the input terminal to the output terminal increases, as the control voltages increase with respect to ground.

29. The communications apparatus of claim 27, wherein:

the first and second control terminals are resistively coupled to the respective anodes of the first and second diodes and the respective corresponding ends of the first and second lines;

the input and output terminals are capacitively coupled to the respective opposite ends of the first and second lines; and the respective opposite ends of the first and second lines are capacitively coupled to ground.

* * * * *